United States Patent [19]

Cetina

[11] 4,205,876

[45] Jun. 3, 1980

[54] CONVERTIBLE FURNITURE ARTICLE

[76] Inventor: Robert E. Cetina, R.R. 1, River Rd., Shorewood, Ill. 60436

[21] Appl. No.: 899,414

[22] Filed: Apr. 24, 1978

[51] Int. Cl.[2] ..... A47N 9/02

[52] U.S. Cl. ..... 297/118; 5/101; 297/270

[58] Field of Search ..... 297/1, 2, 3, 193, 118, 297/270, 272; 5/101, 102, 103, 104, 105, 106, 107

[56] References Cited

U.S. PATENT DOCUMENTS

| | | | |
|---|---|---|---|
| 8,468 | 10/1851 | Knowles | 5/101 |
| 27,964 | 4/1860 | Brooks | 297/1 |
| 178,945 | 6/1876 | Ocorr | 5/102 |
| 345,098 | 7/1886 | Bandy | 5/102 |
| 1,239,279 | 9/1917 | Loeblein | 297/272 |
| 1,914,473 | 6/1933 | Wilson | 297/270 X |
| 2,560,963 | 7/1951 | Kornegay | 297/270 X |
| 2,776,700 | 1/1957 | Potter et al. | 297/3 |
| 3,547,489 | 12/1970 | Grieser | 297/385 |
| 3,592,506 | 7/1971 | Breslow | 297/118 |
| 4,021,867 | 5/1977 | Maxwell, Jr. | 5/106 |

*Primary Examiner*—Ramon S. Britts
*Assistant Examiner*—Peter A. Aschenbrenner
*Attorney, Agent, or Firm*—Wegner, Stellman, McCord, Wiles & wood

[57] ABSTRACT

A convertible furniture article which may be selectively utilized for a number of different purposes, including serving as a cradle or a bench. In the cradle configuration, the article defines an upwardly opening receptacle which may be utilized for a large number of different purposes, not only as a cradle, but illustratively as a toy box, storage box, magazine rack, knitting or sewing box, pet box, wood box, etc. In the reverse arrangement, the article may function not only as a bench, but as a stool, a child's table, a lap table, etc. The article may be provided with integral handles for facilitated carrying and manipulation. The article may be arranged to provide a rocking action in one disposition thereof. The article may be arranged selectively to provide a stabilized support in one or more different dispositions thereof. Stops may be provided for limiting the movement of the article in the rocking action.

1 Claim, 18 Drawing Figures

CONVERTIBLE FURNITURE ARTICLE

BACKGROUND OF THE INVENTION

1. Field of the Invention

This invention relates to furniture and in particular to a multipurpose furniture article.

2. Description of the Prior Art

In U.S. Pat. No. 3,335,432 of Benjamin Stopek, a convertible toy cradle and crib for a doll is shown as adapted for use selectively as a cradle or as a crib. The article includes pivotally mounted legs which, when the article is used as a cradle, are folded against the bottom wall of the article. When the legs are unfolded and extended, they provide a raised position of the article for effectively simulating and permitting use of the article as a crib.

In Design Patent 214,124, Percy E. Grooms shows a combined portable crib and compartmented storage container.

In Design Patent 207,302 of Robert Lerner, a portable collapsible crib is illustrated.

In U.S. Pat. 2,720,253, John E. Turner shows a knockdown article of furniture wherein different panel portions are interlocked by cooperating slots and tongue portions.

In Design Patent 236,767, John W. McKelvey shows a cradle having heart-shaped portions.

In U.S. Pat. No. 3,940,040 of Earl M. Haulter, a carrying device for a doll and cradle is shown to include a pair of elements adapted to rest on the shoulders of the user of the device and mount a receptacle member removable thereto.

SUMMARY OF THE INVENTION

The present invention comprehends an improved convertible furniture article which provides a multiplicity of functions in a novel and simple construction.

More specifically, in the illustrated embodiment, the article is selectively utilized as a cradle or as a bench as a function of the inverted disposition thereof. In the cradle mode, the lowermost portions of the end walls define rocking surfaces and in the bench mode, the lowermost portions of the end walls define table support surfaces.

The article includes a base wall and sidewalls extending between the end walls to define an upwardly opening receptacle when the article is arranged in the cradle mode. Thus, the article is adapted to serve any additional functions in addition to the cradle function in storing a wide variety of objects.

In the bench mode, the article is further adapted to serve as a table. The upper surface portion of the base wall in the bench mode may comprise a chalkboard, a pegboard, a magnetic board, etc., to provide a wide range of different functional uses of the article when arranged in the bench mode.

The rounded ends of the end walls may be provided with stop surfaces so as to limit the rocking movement of the article in the cradle mode. The end walls may be provided with suitable cutouts forming handles for facilitated manipulation and carrying. Such cutouts may be provided at either or both ends of the end walls to provide such manipulating and carrying functions when the article is arranged in either mode.

The sidewalls may be provided with cutouts defining handles, as desired.

A handle may be extended between the end walls above the open receptacle of the article when arranged in the cradle mode whereby the article may define a construction generally similar to that of the tool box. In such an arrangement, a removable cover may be provided for closing the receptacle.

The stabilizing means of the end walls may comprise planar surface poritons thereof. Alternatively, the end portions of the end walls may be arranged to define spaced legs. If desired, the end walls may be provided with rolling elements, such as casters, for facilitating movement of the article when arranged in the bench mode.

The end walls may be provided with suitable securing straps for securing a child to the article when arranged in the bench mode, thus permitting the article to be used in combination with a conventional chair to form a safety-type booster chair or high chair.

The article is adapted not only for use by children, but may be utilized for conventional furniture uses, such as coffee table, end table, step stool and similar uses.

The furniture article of the present invention is extremely simple and economical of construction while yet providing the highly desirable features discussed above.

BRIEF DESCRIPTION OF THE DRAWINGS

Other features and advantages of the invention will be apparent from the following description taken in connection with the accompanying drawing wherein.

DESCRIPTION OF THE PREFERRED EMBODIMENTS

Figures 1, 2, 3, 4, 5, 6:
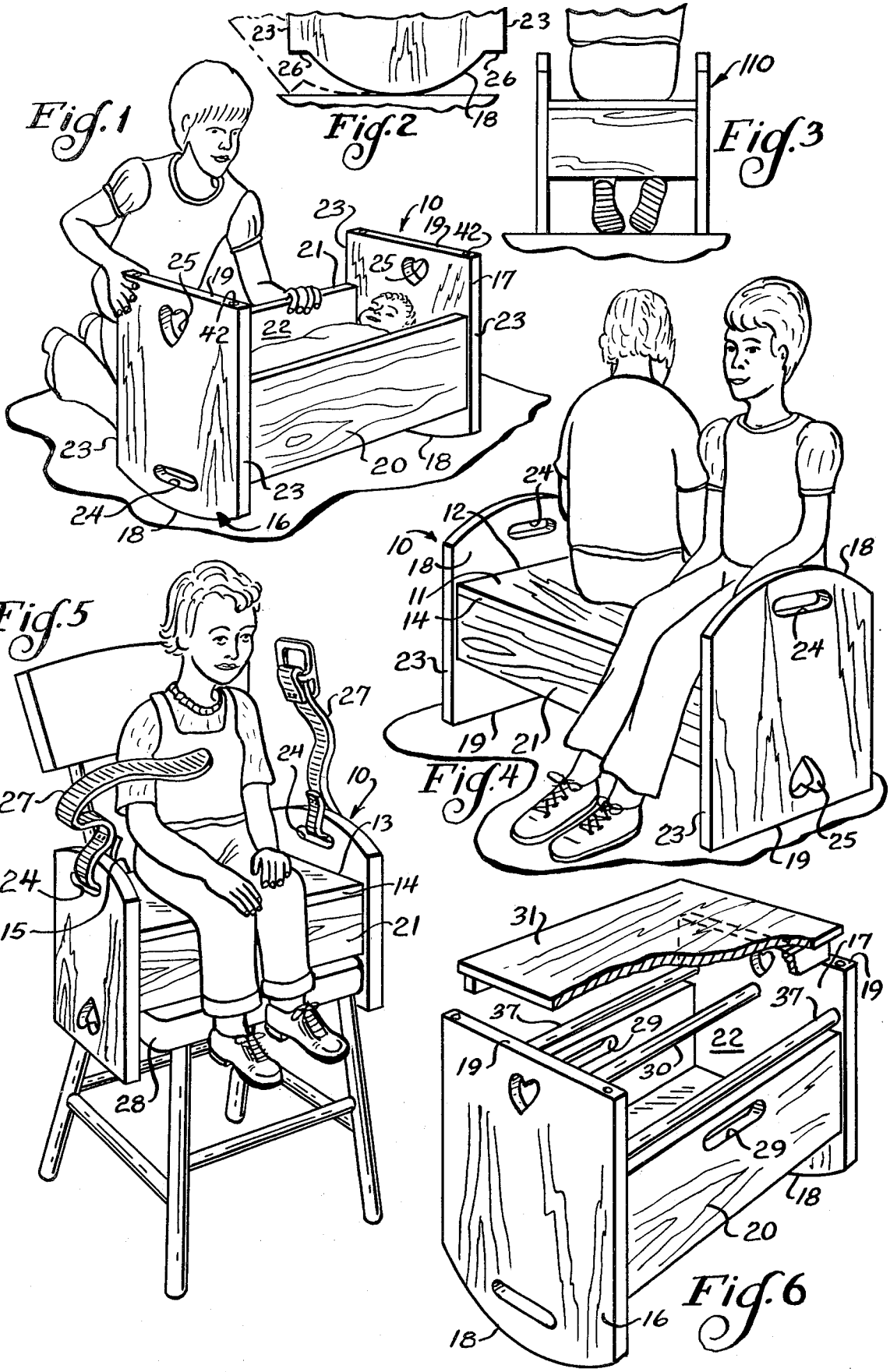
FIG. 1 is a perspective view of a convertible furniture article embodying the invention showing a child utilizing the article in the crib mode.
FIG. 2 is a fragmentary end elevation of the article illustrating the use of the stop means for limiting the rocking action in the crib mode.
FIG. 3 is a side elevation illustrating the use of the article as a bench.
FIG. 4 is a perspective view illustrating the use of the article as a bench for supporting two children concurrently.
FIG. 5 is a perspective view illustrating the use of the article with the safety straps and in combination with a conventional chair to form a safety booster chair or high chair for a child.
FIG. 6 is a perspective view of the article provided with a handle extending between the end walls thereof and a removable cover for use of the article in the manner of a tool box.

In the exemplary embodiments of the invention as dislcosed in the drawing, a convertible furniture article generally designated 10 is shown to comprise alternatively a rockable article, such as for use as a cradle as shown in FIG. 1, or a stabilized article, such as for use in defining a bench, as shown in FIG. 4.

In the illustrated embodiment, the article includes a base wall 11 having opposite ends 12 and 13 and opposite sides 14 and 15.

The article further includes a first end wall 16 and an opposite second end wall 17. One end of the end wall 16 defines a rounded rocking surface 18 and the opposite end of the end wall 16 defines a stabilizing support means 19. Walls 16 and 17 are secured to the opposite ends 12 and 13 of the base wall with the rocking surfaces 18 disposed in one direction from the base wall ends and the stabilizing supports 19 disposed in the opposite direction therefrom, as shown in FIG. 1.

As further shown in FIG. 1, the article further includes a right sidewall 20 and a left sidewall 21 adjacent sides 15 and 14 of the base wall, respectively.

The sidewalls extend upwardly from the base wall to define with the base wall and the end walls an upwardly opening receptacle generally designated 22 when the rocking surfaces 18 are lowermost, as shown in FIG. 1. The sidewalls define a stable support extending downwardly from the base wall when the stabilizing means 19 are lowermost, as shown in FIG. 4. As illustrated in each of FIGS. 1 and 4, the sidewalls 20 and 21 extend vertically in each of the reversed arrangements of the article 10 substantially parallel to the side edges 23 of the end walls.

Thus, the article 10 defines a rockable cradle when the rocking surfaces 18 are lowermost and a bench when the stabilizing support means 9 are lowermost.

The invention further comprehends the provision of suitable handle means on the furniture article 10 for facilitated manipulation and carrying. In the illustrated embodiment, the end walls are provided with integral handle means in the form of an opening 24 in each of the end walls adjacent the rocking surface 18.

The end walls may be further provided with a second opening 25 adjacent the end defining the stabilizing means 19. In the illustrated embodiment, the openings 25 may be heart-shaped to provide a decorative function as well as form handles in the end walls when the furniture article is arranged in the crib mode with the rocking surfaces 8 lowermost, as shown in FIG. 1.

As illustrated in FIG. 2, in one modified form, the rocking surfaces 18 are defined at their opposite ends by stop surfaces 16 which, as shown in borken lines in FIG. 2, limit the rolling action of the rounded surfaces 18, thereby to limit the rocking of the cradle within safe limits. In the illustrated embodiment, the surfaces 26 extend transversely to the rounded surfaces 18 and, more specifically, perpendicular to the side edges 23 of the end walls.

As shown in Fig. 3, the length of the furniture article 110 may be somewhat shorter than that of article 10 so as to define a bench suitable for supporting a single child. Article 10, as shown in FIG. 4, is adapted for supporting two children in side-by-side relationship. Illustratively, the article 10 may have a length of approximately 20 inches, with a height of approximately 15 inches, and a width of approximately 11 inches.

As shown in FIG. 5, the furniture article may be provided with suitable buckle straps 27 which may serve as straps for holding a child in place on the bench 10, such as when the bench is utilized on a conventional chair 28 as an upward extension thereof so as to cooperatively define therewith a safety booster high chair. As shown in FIG. 5, the straps 27 may be secured to the end walls of the article by extension thereof through the openings 24 in the opposite end walls.

Referring to FIG. 6, the sidewalls 20 and 21 may be provided with openings 29 to define additional or alternative handles for manipulating and carrying the furniture article as desired.

As further illustrated in FIG. 6, the furniture article may be provided with a rod handle 30 extending between the end walls 16 and 17 adjacent the stabilizing ends 19 thereof. As thus provided, the furniture article simulates a tool box wherein the open receptacle 22 is adapted for receiving tools and the like. In such an arrangement, a removable cover 31 may be provided for selectively closing the receptacle space 22.

Figure 7:
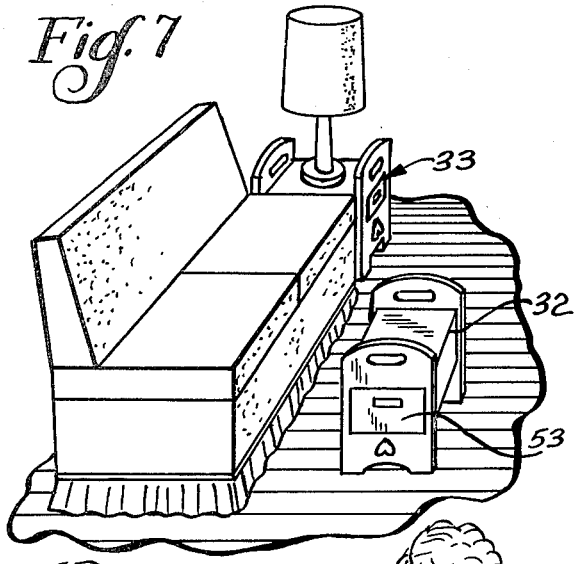
FIG. 7 is a perspective view illustrating the use of the article as a coffee table, or footstool, and as an end table.
Figure 8:
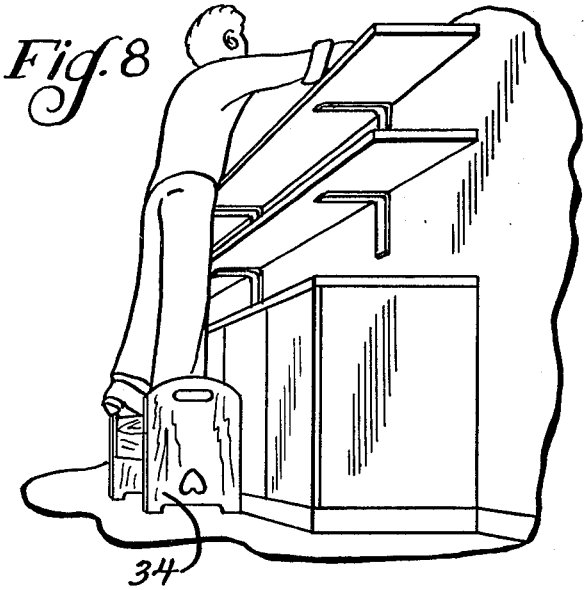
FIG. 8 is a perspective view illustrating the use of the article as a step stool.

As illustrated in FIG. 7, the furniture articles are adapted further for use as conventional furniture articles, such as a coffee table, or footstool, 32, or as an end table 33. As further illustrated in FIG. 8, the furniture article may be utilized as a conventional step stool 34.

Figure 9:
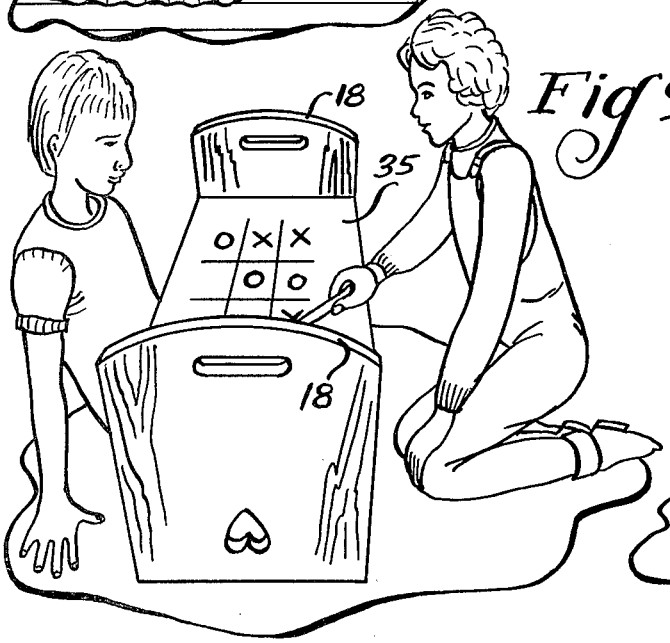
FIG. 9 is a perspective view iluustrating the use of the article as a chalkboard table.

As illustrated in FIG. 9, the base wall may be defined on its upper surface, i.e., when the article is arranged in the bench mode with the rocking surfaces 18 uppermost, provided with a chalkboard 35, or similar erasable panel means.

Figure 10:
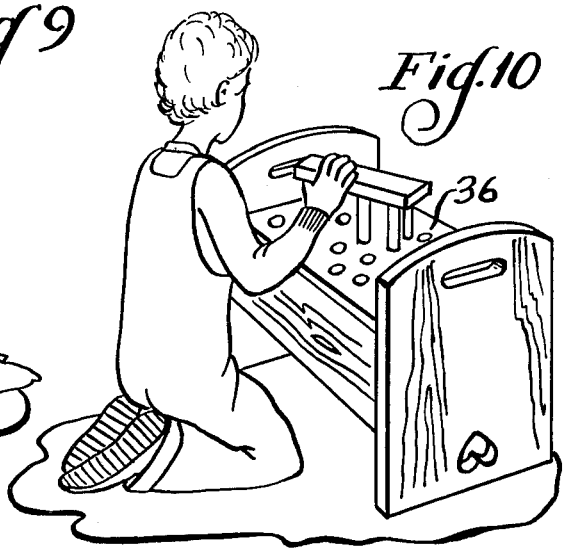
FIG. 10 is a perspective view illustrating the use of the article as a pegboard table.

As shown in FIG. 10, the upper surface of the base wall may be provided with a pegboard 36.

Alternatively, the base wall may define a magnetic surface, a game board, etc. Where the base wall is formed of wood, it is preferable that the wood have sufficient thickness and strength so as to permit the base wall to define a pounding board or the like.

The illustrative uses of the furniture article are exemplary only, it being understood that the furniture article is adapted for use in many other applications within the scope of the invention. Such applications include applications for use with adults, such as in the use of the furniture table as a lap table, a portable magazine rack, a knitting or sewing box, a plant table in the bench position, and a gravel-filled potted plant holder in the cradle position, a woodbox, a record or tape cartridge stroage box, a carpenter's box, a button box, a pet box, etc.

If desired, the furniture article may be made of suitable size so that the article may serve as an actual baby cradly such as for facilitating babysitting, or use in an automobile. The article may be readily adapted for use as a game table having removable prepainted gameboards selectively affixed to the base wall, as desired.

The illustrative handles comprise openings formed integrally in the end walls or sidewalls as desired, it being understood that the size of the openings may be preselected so as to permit their use either for children alone or of sufficient size to permit their use by adults. As will be obvious to those skiled in the art, the handles may comprise handles attached to the article as by screws or the like, as desired. The use of the integral opening-forming handles provides an improved low cost, highly aesthetic handle arrangement inasmuch as the openings can be suitably designed not only for handle uses, but also for aesthetic purposes.

If desired, rotatable dowel rods 37 may be provided, as shown in FIG. 6, extending between the end walls 16 and 17 above the sidewalls 20 and 21 with the article arranged in the cradle mode, i.e., with the curved surfaces 18 lowermost. In the illustrated embodiment, the dowel rods are at least approximately 1" from the sidewalls and are rotatably mounted in the end walls. In addition to enhancing the aesthetic appeal of the article, the dowel rods 37 may serve as handles in lieu of the handle openings 29.

Figure 11:
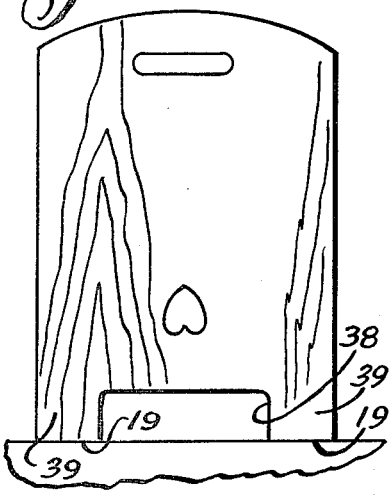
FIG. 11 is an end view illustrating a modified form of the article wherein the stabilizing surface defines a pair of spaced legs.
Figure 12:
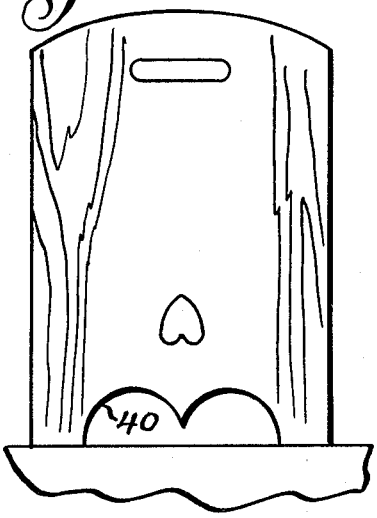
FIG. 12 is an end view similar to that of FIG. 11 but wherein the end surface is provided with an arcuate recess to define the spaced legs.
Figure 13:
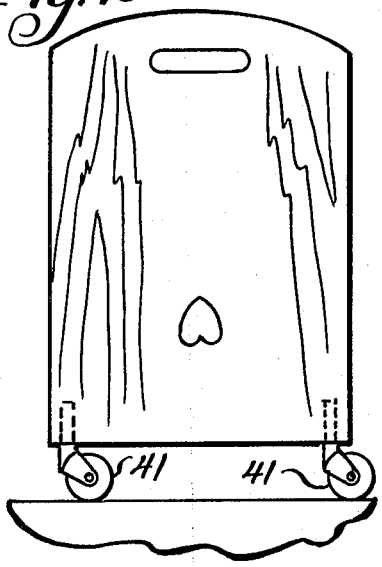
FIG. 13 is an end view illustrating the use of casters in supporting the article in the bench mode.

Referring to FIGS. 11–13, the furniture article may utilize modified forms of stabilizing supports when arranged in the bench mdoe. Thus, as shown in FIG. 11, the end walls may be provided with downwardly opening central cutouts 38 whereby the stabilizing surfaces 19 are defined by spaced legs 39 at the opposite sides of the end walls. As shown in FIG. 12, the cutout 40 may comprise an arcuate cutout in lieu of the generally rectangular cutout 38 of FIG. 11.

As shown in FIG. 13, the support of the article in the bench mode may be by means of suitable rolling elements, such as casters 41, for permitting facilitated movement of the article in the bench mode.

As shown in FIG. 1, the planar stabilizing surfaces 19 may be provided with conventional furniture glides 42, if desired. Such glides may be utilized with the legs of FIGS. 11 and 12, as will be obvious to those skilled in the art.

In the illustrated embodiment, the sidewalls are spaced from the level of the end wall surfaces 19 so that when the article is intended for use as a lap table, the user's legs may fit freely under the sidewalls. The base wall 11, as seen in FIG. 4, is spaced substantially below the level of the rocking surface 18 so that the projecting portions of the end walls serve as arm rests when the furniture article is utilized as a bench.

Figure 14:
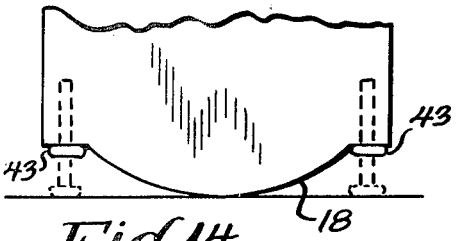
FIG. 14 is a fragmentary end view of a modified form of the article provided with adjustable stabilizing means.

As shown in FIG. 14, adjustable glides 43 may be provided at the opposite ends of the rocking surface 18 so as to provide an adjustable limit to the rocking movement. Further, as shown in dotted lines in FIG. 14, the glides may be adjusted so as to effectively prevent all rocking movement by suitably adjusting the glides to extend to a tangent to the rocking surface 18 corresponding to the floor level on which the article is placed.

Figure 15:
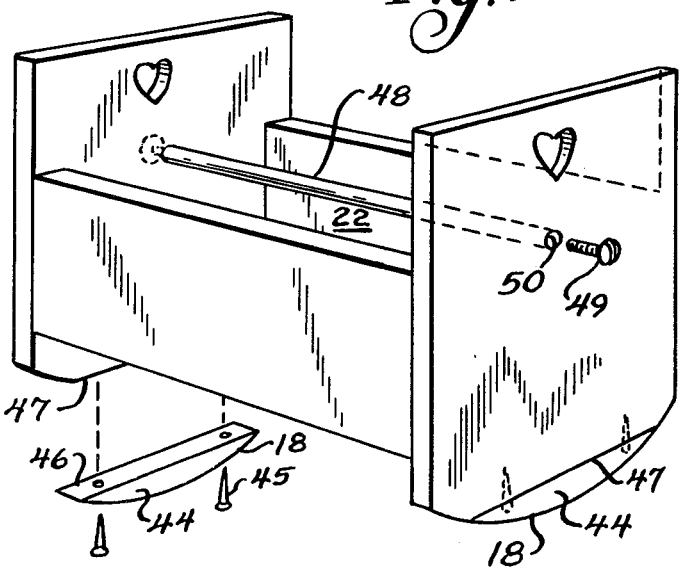
FIG. 15 is a partially exploded perspective view of another form of the article having removable rocking surface means.

Referring now to FIG. 15, the end walls of the article may be provided with removable end portions 44 which may be secured to the end walls by suitable means, such as screws 45. The removable portions 44 may define the rounded surfaces 18 of one end of the end wall. The upper surface 46 of the end wall portions 44 may be planar in conformity with a planar lower surface 47 of the end wall so that when the portions 44 are removed, the end walls define stabilizing end surfaces at both ends.

As further shown in FIG. 15, a longitudinal handle 48 may be disposed within the receptacle 22 extending between the end walls and being secured thereto by suitable screws 49 extending through suitable openings 50 in the end walls and into engagement with the opposite ends of the handle.

Figure 16:
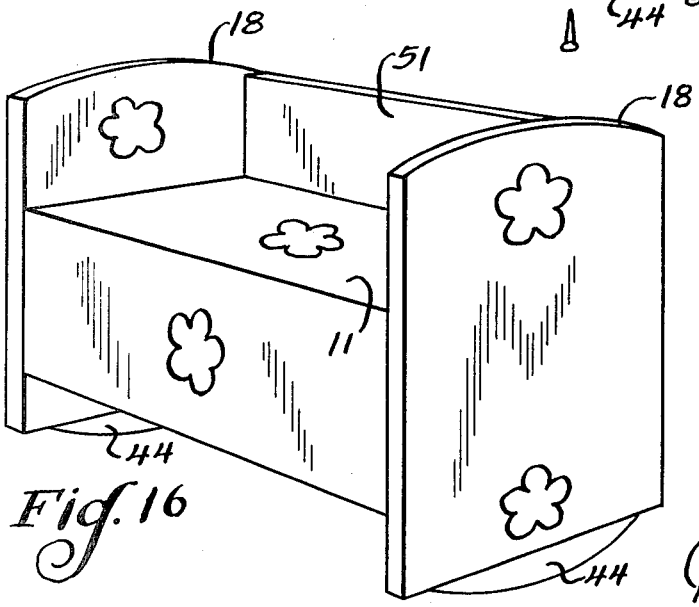
FIG. 16 is a perspective view of still another form of the article having an extended sidewall defining a seat back portion thereof.

Referring now to the embodiment of FIG. 16, the article may be provided with a backrest 51 extending from the base wall 11 to adjacent the rounded surfaces 18 of the end walls. As will be obvious to those skilled in the art, the backrest 51 may comprise a continuation of one sidewall, such as sidewall 20, or may comprise a separate wall member as desired. As further shown in FIG. 16, the article may include the removable extensions 44 so that when installed in the article, the article may comprise a rocking chair having a backrest portion and side arm support portions.

Figure 17:
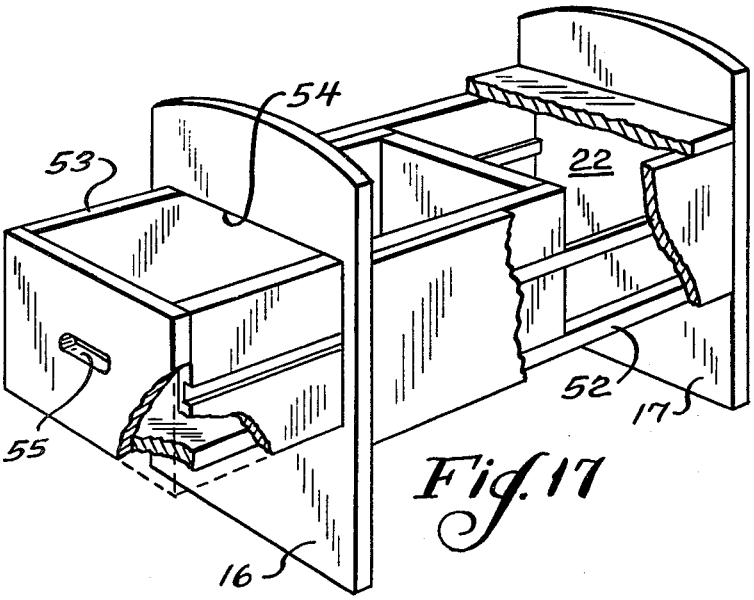
FIG. 17 is a perspective view with portions broken away, illustrating a construction of the article utilizing a removable drawer.

Still further, referring to FIG. 17, the article may be provided with suitable guides 52 extending between the end walls 16 and 17 within the receptacle 22 for slidably supporting a drawer 53 for selective disposition within the receptacle 22 in a retracted position, or at least partially projecting outwardly from an opening 54 in one of the end walls, such as end wall 16, in an exposed position shown in FIG. 17. The drawer may be provided with a suitable handle means, such as cutout handle 55, for manipulating the drawer between the retracted and exposed positions.

In yet another form, the article may be arranged with the sidewalls 20 and 21 spaced inwardly from the side edges 56 and 57 of the end walls so that the article may be used as a seat or bench when disposed on its side, i.e., with either of the side edges 57 or 56 lowermost, as well as when the article is arranged with the stabilizing surface 19 lowermost.

Figure 18:
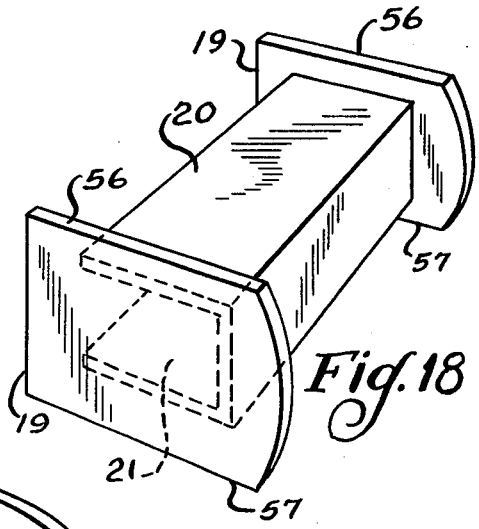
FIG. 18 is a perspective view of another form of the article adapted for use as a bench while disposed on its side as well as in an upright position.

In each of the modified forms of FIGS. 16, 17 and 18, the article may serve as a rockable crib when the receptacle portion is exposed uppermost. Relative to the drawer arrangement of FIG. 17, the user may simply invert the drawer when it is desired to use the article as a crib so that the interior of the drawer may serve as the exposed crib space.

A number of different modifications of the article are shown in different embodiments. It is to be understood that any of the modifications may be utilized with any of the other forms illustrated within the scope of the invention.

As will be obvious to those skilled in the art, the furniture article may be provided with other suitable modifications, as desired, within the scope of the invention.

The foregoing disclosure of specific embodiments is illustrative of the broad inventive concepts comprehended by the invention.

I claim:

1. A multipurpose furniture article comprising:

a base wall defining opposite ends and opposite sides;

a first end wall having one end defining a rounded rocking surface, an opposite end defining stabilizing support means, and side edges;

a second end wall having one end defining a rounded rocking surface, an opposite end defining stabilizing support means, and side edges, said end walls being secured to said opposite ends of the base wall with said rocking surfaces spaced in one direction adjacent said base wall ends and said stabilizing support means spaced in the opposite direction substantially from said base wall; and sidewalls extending from said opposite sides of the base wall toward such stabilizing support means to define with said base wall and said end walls an upwardly open receptacle spaced below said stabilizing support means when said rocking surfaces are lowermost and defining a stable support extending downwardly from said base wall sides when said stabilizing means are lowermost, said sidewalls being spaced inwardly adjacent said side edges of said end walls, said article defining a rockable cradle when said rocking surfaces are lowermost and a bench when said stabilizing support means are lowermost, each of said end walls being provided with a first opening adjacent said stabilizing support means defining a pair of spaced, rounded carrying and manipulating surfaces, at least one of the two end walls and two sidewalls being provided each with an opening elongated in a direction perpendicular to said end wall side edges and defining horizontally extending upper and lower rectilinear carrying and manipulating surfaces, the elongated openings in said end walls being spaced from said base wall at least one-half the distance from the base wall to said rocking surface, said stabilizing support means being defined by a pair of downwardly projecting integral leg portions adjacent said side edges and an intermediate downwardly opening recess, said leg portions being provided with furniture glides.

* * * * *